US011263954B2

(12) United States Patent
Liu et al.

(10) Patent No.: US 11,263,954 B2
(45) Date of Patent: Mar. 1, 2022

(54) PIXEL CIRCUIT INCLUDING AN ULTRASONIC RECOGNITION CIRCUIT, METHOD FOR DRIVING THE SAME, AND DISPLAY PANEL

(71) Applicants: Chengdu BOE Optoelectronics Technology Co., Ltd., Chengdu (CN); BOE Technology Group Co., Ltd., Beijing (CN)

(72) Inventors: Ke Liu, Beijing (CN); Ling Shi, Beijing (CN); Bingqiang Gui, Beijing (CN); Wenqiang Li, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/180,961

(22) Filed: Feb. 22, 2021

(65) Prior Publication Data

US 2021/0264846 A1 Aug. 26, 2021

(30) Foreign Application Priority Data

Feb. 24, 2020 (CN) ..... 202010112067.X

(51) Int. Cl.

| | |
|---|---|
| ***G09G 3/20*** | (2006.01) |
| ***G09G 3/3258*** | (2016.01) |
| ***G09G 3/3266*** | (2016.01) |
| ***G09G 3/3291*** | (2016.01) |

(52) U.S. Cl.

CPC ..... *G09G 3/2092* (2013.01); *G09G 3/3258* (2013.01); *G09G 3/3266* (2013.01); *G09G 3/3291* (2013.01)

(58) Field of Classification Search

None

See application file for complete search history.

(56) References Cited

U.S. PATENT DOCUMENTS

2020/0403045 A1* 12/2020 Yeon ..... G09G 3/32

* cited by examiner

*Primary Examiner* — Kirk W Hermann

(74) *Attorney, Agent, or Firm* — Arent Fox LLP; Michael Fainberg

(57) ABSTRACT

A pixel driving circuit and an ultrasonic line recognition circuit are coupled to a same power supply terminal, a same first control signal terminal and a same scanning signal terminal; and the ultrasonic line recognition circuit is coupled to an ultrasonic device, and the pixel driving circuit is coupled to a data signal terminal and a light emitting device.

10 Claims, 11 Drawing Sheets

PIXEL CIRCUIT INCLUDING AN ULTRASONIC RECOGNITION CIRCUIT, METHOD FOR DRIVING THE SAME, AND DISPLAY PANEL

The present application claims a priority of the Chinese Patent Application filed to the Chinese Patent Office on Feb. 24, 2020 with the application number 202010112067.X which is incorporated herein by reference in its entirety.

FIELD

The present application relates to the technical field of display, and in particular to a pixel circuit, a method for driving the same, and a display panel.

BACKGROUND

Fingerprint recognition is a type of biometric recognition. In recent years, with the rapid development of technology, fingerprint recognition has been widely used in smart phones, security devices and other fields. At present, common fingerprint recognition schemes are optical, capacitive and ultrasonic. Ultrasonic fingerprint recognition has attracted much attention because of its good penetration, high accuracy, underwater unlocking and living body recognition, etc.

SUMMARY

An embodiment of the present application provides a pixel circuit, a method for driving the same, and a display panel.

An embodiment of the present application provides a pixel circuit, the pixel circuit includes a pixel driving circuit and an ultrasonic line recognition circuit; the pixel driving circuit and the ultrasonic line recognition circuit are coupled to a same power supply terminal, a same first control signal terminal and a same scanning signal terminal; the ultrasonic line recognition circuit is coupled to an ultrasonic device; and the pixel driving circuit is coupled to a data signal terminal and a light emitting device;

in a first stage: under a control of the first control signal terminal, the ultrasonic line recognition circuit provides a scanning signal of the scanning signal terminal to the ultrasonic device as an ultrasonic emission signal; and under a control of the first control signal terminal and the scanning signal terminal, the pixel driving circuit writes a reset signal of the data signal terminal and a power signal of the power supply terminal to compensate a threshold voltage;

in a second stage: under the control of the first control signal terminal and the scanning signal terminal, the ultrasonic line recognition circuit outputs a line recognition signal according to a received ultrasonic signal of the ultrasonic device, and the pixel driving circuit writes a data signal of the data signal terminal; and in a third stage: under the control of the first control signal terminal and the scanning signal terminal, the pixel driving circuit drives the light emitting device to emit light.

Optionally, the ultrasonic line recognition circuit includes: a first control module and a reading module;

a control terminal of the first control module is coupled to the first control signal terminal, a first terminal of the first control module is coupled to the scanning signal terminal, and a second terminal of the first control module is coupled to the ultrasonic device;

a first control terminal of the reading module is coupled to the scanning signal terminal, a second control terminal of the reading module is coupled to the ultrasonic device, a first terminal of the reading module is coupled to the power supply terminal, and a second terminal of the reading module outputs the line recognition signal;

in the first stage: the first control module is configured to turn on the scanning signal terminal and the ultrasonic device under the control of the first control signal terminal; and in the second stage: the first control module is configured to turn off the scanning signal terminal and the ultrasonic device under the control of the first control signal terminal; and the reading module is configured to output the line recognition signal according to the ultrasonic signal under the control of the scanning signal terminal.

Optionally, the first control module includes a first transistor;

a gate of the first transistor is coupled to the first control signal terminal, a first electrode of the first transistor is coupled to the scanning signal terminal, and a second electrode of the first transistor is coupled to the ultrasonic device.

Optionally, the reading module includes a second transistor and a third transistor;

a gate of the second transistor is coupled to the ultrasonic device, a first electrode of the second transistor is coupled to the power supply terminal, a second electrode of the second transistor is coupled to a first electrode of the third transistor, a gate of the third transistor is coupled to the scanning signal terminal, and a second electrode of the third transistor outputs the line recognition signal.

Optionally, the first transistor and the third transistor are P-channel transistors, and the second transistor is an N-channel transistor.

Optionally, the pixel driving circuit includes a driving module, a data writing module, a charging module, and a second control module;

a control terminal of the data writing module is coupled to the scanning signal terminal, a first terminal of the data writing module is coupled to the data signal terminal, and a second terminal of the data writing module is coupled to a first terminal of the charging module;

a second terminal of the charging module is coupled to the power supply terminal, and a third terminal of the charging module, a control terminal of the driving module and a second terminal of the second control module are coupled to a first node respectively;

a first terminal of the driving module is coupled to the power supply terminal, and a second terminal of the driving module is coupled to the light emitting device and a first terminal of the second control module;

a control terminal of the second control module is coupled to the first control signal terminal;

in the first stage: the data writing module is configured to turn on the data signal terminal and the charging module, and write a reset signal of the data signal terminal into the charging module under the control of the scanning signal terminal; the driving module is configured to control to turn on the power supply terminal and the second control module according to a potential of the first node; the second control module is configured to charge the first node by using a power signal of the power supply terminal under the control of the first control signal terminal, and when the potential of the first node reaches a first preset potential, the driving module is further configured to control to turn off the power supply terminal and the second control module according to the potential of the first node;

in the second stage: the data writing module is configured to turn on the data signal terminal and the charging module, and write the data signal of the data signal terminal into the charging module under the control of the scanning signal terminal, for the potential of the first node becoming a second preset potential; and in the third stage: the data writing module is configured to turn off the data signal terminal and the charging module under the control of the scanning signal terminal; and the driving module is configured to drive the light emitting device to emit light according to the second preset potential and a potential of the power supply terminal.

Optionally, the driving module includes a fourth transistor;

the data writing module includes a fifth transistor;

the charging module includes: a first capacitor and a second capacitor;

the second control module includes a sixth transistor;

a gate of the fourth transistor is coupled to a first electrode of the first capacitor, a first electrode of the fourth transistor is coupled to the power supply terminal, and a second electrode of the fourth transistor is coupled to the light emitting device and a first electrode of the sixth transistor;

a gate of the fifth transistor is coupled to the scanning signal terminal, a first electrode of the fifth transistor is coupled to the data signal terminal, a second electrode of the fifth transistor is coupled to a second electrode of the first capacitor and a second electrode of the second capacitor, a first electrode of the first capacitor is further coupled to a second electrode of the sixth transistor, and a first electrode of the second capacitor is coupled to the power supply terminal; and a gate of the sixth transistor is coupled to the first control signal terminal.

Optionally, the fourth transistor, the fifth transistor and the sixth transistor are P-channel transistors.

An embodiment of the present application provides a method for driving a pixel circuit, and the method includes:

in the first stage: loading the scanning signal to the scanning signal terminal, loading a first level signal to the first control signal terminal, loading the reset signal to the data signal terminal, loading the power signal to the power supply terminal, providing the scanning signal of the scanning signal terminal to the ultrasonic device as the ultrasonic emission signal through the ultrasonic line recognition circuit, and writing the reset signal and the power signal through the pixel driving circuit to compensate the threshold voltage;

in the second stage: loading the scanning signal to the scanning signal terminal, loading a second level signal to the first control signal terminal, loading the data signal to the data signal terminal, outputting the line recognition signal according to the received ultrasonic signal of the ultrasonic device through the ultrasonic line recognition circuit, and writing the data signal through the pixel driving circuit; and in the third stage: loading the second level signal to the first control signal terminal, loading the scanning signal to the scanning signal terminal, and driving the light emitting device to emit light through the pixel driving circuit.

An embodiment of the present application provides a display panel, and the display panel includes a base substrate, the pixel circuit provided by embodiments of the present application on the base substrate, the ultrasonic device on the pixel circuit, and the light emitting device on the ultrasonic device.

BRIEF DESCRIPTION OF THE DRAWINGS

In order to more clearly explain the technical solutions in the embodiments of the present application, the drawings to be used in the description of the embodiments will be briefly introduced below. Obviously, the drawings in the following description are only some embodiments of the present application. For those of ordinary skill in the art, other drawings can be obtained based on these drawings without inventive efforts.

DETAILED DESCRIPTION OF THE EMBODIMENTS

Among the existing technologies in the market, one of the ultrasonic fingerprint sensors is arranged in a mode of an external module attached to a display panel, with a structure having an independent display area circuit and a logic circuit. This not only increases the overall thickness of the display panel, but also increases power consumption of the panel. The ultrasonic fingerprint sensor can also be arranged in an embedded module mode. The embedded module mode integrates an echo collection circuit of the ultrasonic fingerprint sensor and a display light emitting circuit on the panel at the same time during the manufacturing process. This module mode can reduce the overall film thickness of the panel and is more conducive to ultrasonic penetration. However, circuits in a display area (AA area) and a driving circuit (Gate on Array, GOA) area are complicated, making difficult to achieve high pixel density (Pixels Per Inch, PPI) and frame narrowing. To sum up, in display products of the prior art, there is a problem of poor integration between a fingerprint recognition driving circuit and a pixel driving circuit, which results in a very complicated circuit.

Figure 1:
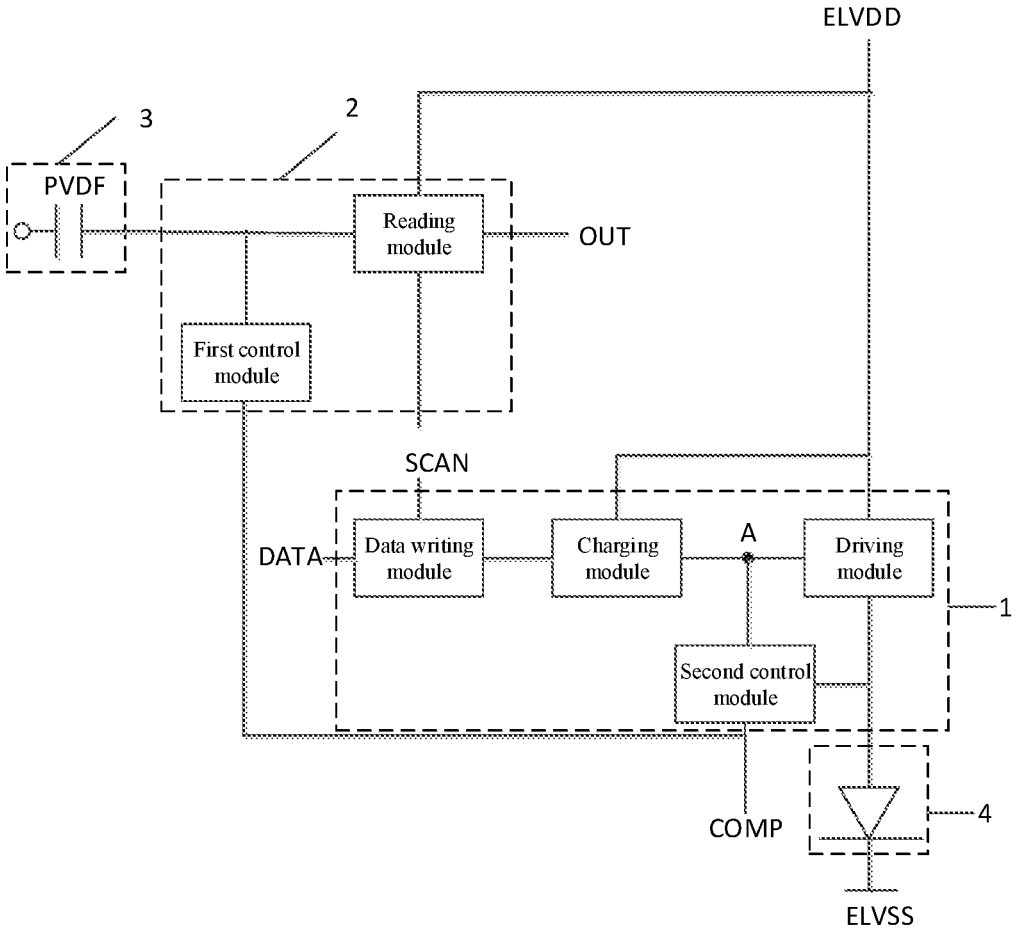
FIG. 1 is a schematic structural diagram of a pixel circuit provided by an embodiment of the present application.
Figure 3:
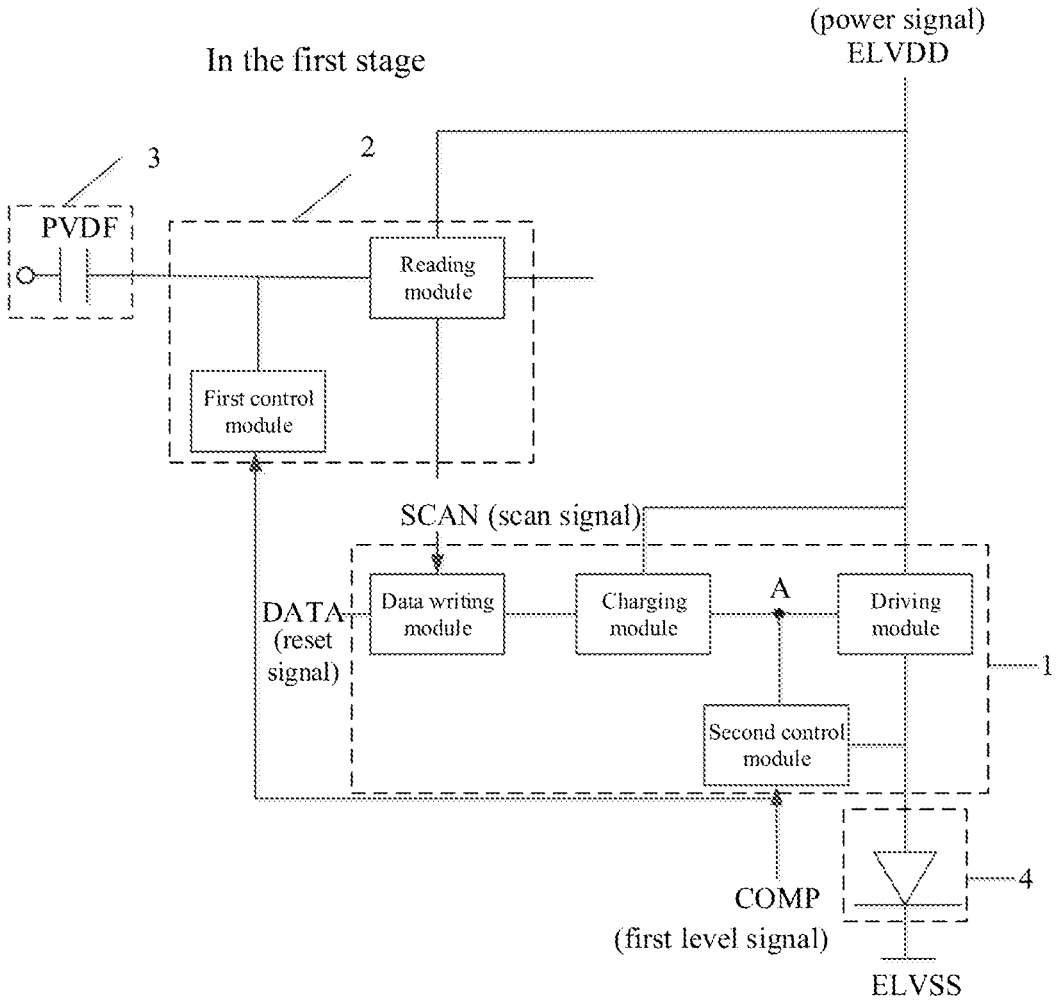
FIGS. 3-5 are schematic structural diagram of the working process a pixel circuit in different stages provided by an embodiment of the present application.
Figure 4:
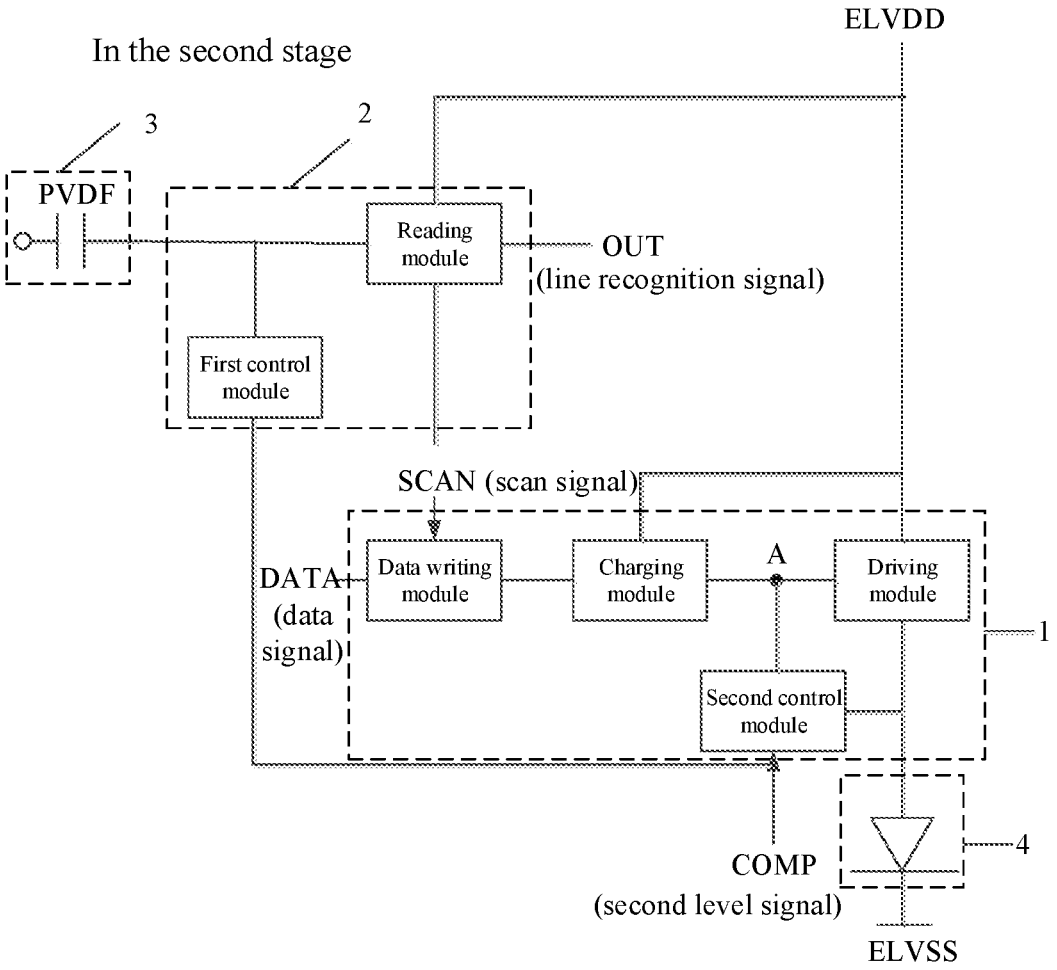
Figure 5:
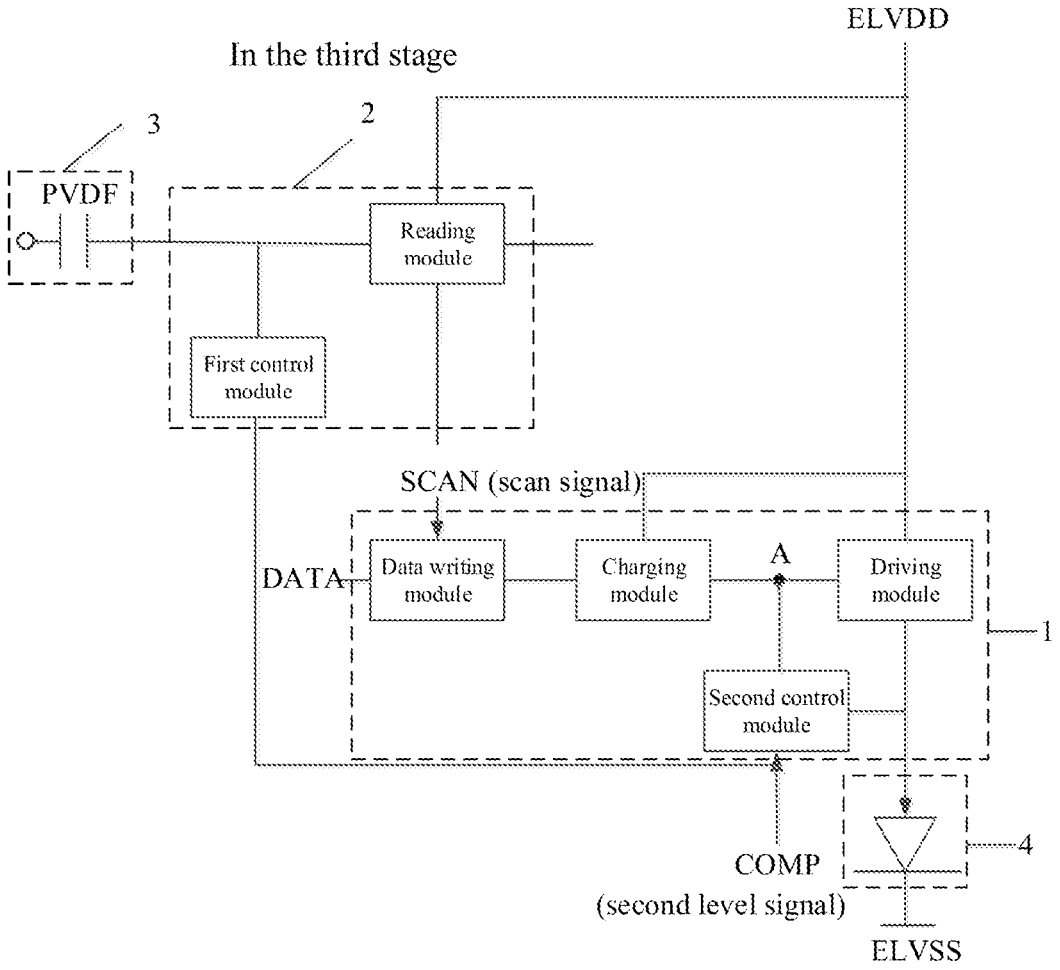

An embodiment of the present application provides a pixel circuit, as shown in FIG. 1, the pixel circuit includes a pixel driving circuit 1 and an ultrasonic line recognition circuit 2; the pixel driving circuit 1 and the ultrasonic line recognition circuit 2 are coupled to a same power supply terminal ELVDD, a same first control signal terminal COMP and a same scanning signal terminal SCAN; and the ultrasonic line recognition circuit 2 is coupled to an ultrasonic device 3, and the pixel driving circuit 1 is coupled to a data signal terminal DATA and a light emitting device 4;

in a first stage: as shown in FIG. 3, under the control of the first control signal terminal COMP, the ultrasonic line recognition circuit 2 provides a scanning signal of the scanning signal terminal SCAN to the ultrasonic device 3 as an ultrasonic emission signal; and under the control of the first control signal terminal COMP and the scanning signal terminal SCAN, the pixel driving circuit 1 writes a reset signal of the data signal terminal DATA and a power signal of the power supply terminal ELVDD to compensate a threshold voltage;

in a second stage: as shown in FIG. 4, under the control of the first control signal terminal COMP and the scanning signal terminal SCAN, the ultrasonic line recognition circuit 2 outputs a line recognition signal according to a received ultrasonic signal of the ultrasonic device 3, and the pixel driving circuit 1 writes a data signal of the data signal terminal DATA; and in a third stage: as shown in FIG. 5, under the control of the first control signal terminal COMP and the scanning signal terminal SCAN, the pixel driving circuit 1 drives the light emitting device 4 to emit light.

That is to say, in the pixel circuit provided by embodiments of the present application, in the first stage, ultrasonic generation and pixel compensation can be performed simultaneously; in the second stage, ultrasonic echo collection and data signal writing can be performed simultaneously; and in the third stage, the light emitting device can be driven to emit light. The pixel driving circuit and the ultrasonic line recognition circuit can realize ultrasonic line recognition and drive a pixel to emit light without affecting each other.

The pixel circuit provided by embodiments of the present application includes a pixel driving circuit and an ultrasonic line recognition circuit; and the pixel driving circuit and the ultrasonic line recognition circuit are coupled to a same power supply terminal, a same scanning signal terminal, and a same first control signal terminal. When performing line recognition, the ultrasonic line recognition circuit can be compatible with a relevant signal of the pixel driving circuit, the ultrasonic line recognition circuit and the pixel driving circuit are integrated to realize the integration of an ultrasonic fingerprint recognition driving circuit and the pixel driving circuit. Therefore, the pixel circuit can realize both an ultrasonic line recognition function and driving of the light emitting device to emit light, which simplifies design complexity of a driving circuit of a display product with a line recognition function. Moreover, the ultrasonic line recognition circuit does not need to be arranged in a GOA area, and a frame size can also be reduced to achieve frame narrowing.

In some embodiments, as shown in FIG. 1, the ultrasonic line recognition circuit 2 includes a first control module and a reading module;

a control terminal of the first control module is coupled to the first control signal terminal COMP, a first terminal of the first control module is coupled to the scanning signal terminal SCAN, and a second terminal of the first control module is coupled to the ultrasonic device 3;

a first control terminal of the reading module is coupled to the scanning signal terminal SCAN, a second control terminal of the reading module is coupled to the ultrasonic device 3, a first terminal of the reading module is coupled to the power supply terminal ELVDD, and a second terminal OUT of the reading module outputs the line recognition signal;

in the first stage: the first control module is configured to turn on the scanning signal terminal SCAN and the ultrasonic device 3 under the control of the first control signal terminal COMP; and in the second stage: the first control module is configured to turn off the scanning signal terminal SCAN and the ultrasonic device 3 under the control of the first control signal terminal COMP; and the reading module is configured to output the line recognition signal according to the ultrasonic signal under the control of the scanning signal terminal SCAN.

Figure 2:
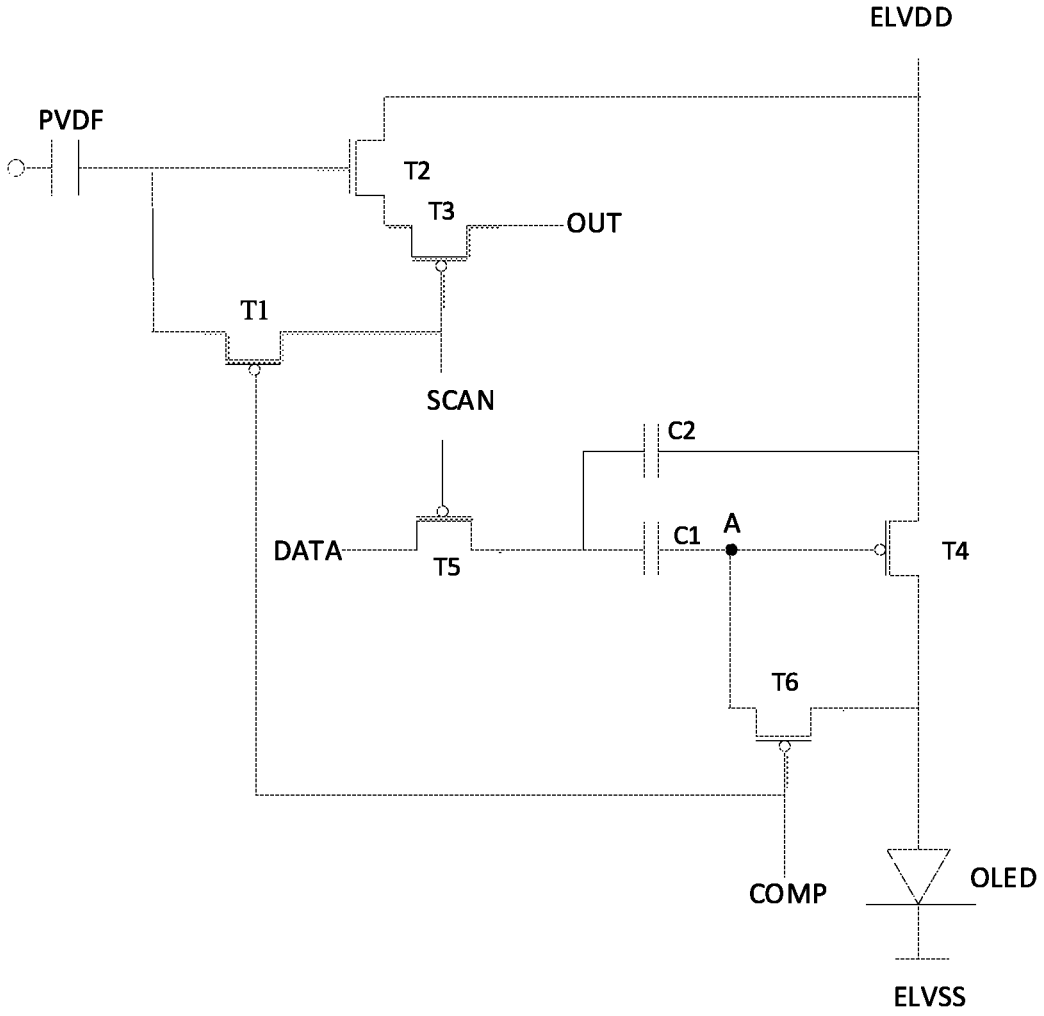
FIG. 2 is a schematic structural diagram of another pixel circuit provided by an embodiment of the present application.

In some embodiments, as shown in FIG. 2, the first control module includes a first transistor T1;

a gate of the first transistor T1 is coupled to the first control signal terminal COMP, a first electrode of the first transistor T1 is coupled to the scanning signal terminal SCAN, and a second electrode of the first transistor T1 is coupled to the ultrasonic device 3.

In some embodiments, in the first stage: the first transistor T1 is turned on under the control of the first control signal terminal COMP, and a scanning signal of the scanning signal terminal SCAN is written into the ultrasonic device for ultrasonic emission; in the second stage: there is no need to provide a scanning signal for the ultrasonic device, and the first transistor T1 is turned off under the control of the first control signal terminal COMP. In the third stage: the ultrasonic line recognition circuit does not need to work, and the first transistor T1 is turned off under the control of the first control signal terminal COMP, and will not provide an ultrasonic emission signal to the ultrasonic device.

In some embodiments, as shown in FIG. 2, the reading module includes a second transistor T2 and a third transistor T3;

a gate of the second transistor T2 is coupled to the ultrasonic device 3, a first electrode of the second transistor T2 is coupled to the power supply terminal ELVDD, a second electrode of the second transistor T2 is coupled to a first electrode of the third transistor T3, a gate of the third transistor T3 is coupled to the scanning signal terminal SCAN, and a second electrode of the third transistor T3 outputs the line recognition signal.

In some embodiments, in the first stage, the ultrasonic device does not receive a signal reflected back from a fingerprint ridge and valley, and the second transistor T2 is turned off; in the second stage, the third transistor T3 is turned on under the control of the scanning signal terminal, and the second transistor is turned on by receiving the signal reflected back from the fingerprint ridge and valley. However, energy of an ultrasonic wave reflected back from the fingerprint ridge and valley varies, a signal strength written into a control electrode of the second transistor by the ultrasonic device varies, so an on degree of the second transistor T2 varies. Therefore, a source current of the second transistor T2 varies, so that the fingerprint ridge and valley can be distinguished by a signal output from the second terminal OUT of the third transistor. In the third stage, the ultrasonic line recognition circuit does not need to work, and the third transistor T3 is turned off under the control of a scanning signal of the scanning signal terminal, and no line recognition signal is output.

In some embodiments, as shown in FIG. 2, the first transistor T1 and the third transistor T3 are P-channel transistors, and the second transistor T2 is an N-channel transistor.

In some embodiments, in the first stage: the first control signal terminal COMP provides a first level signal with a low level, the first transistor T1 is turned on, the scanning signal of the scanning signal terminal SCAN is a low level signal, the third transistor T3 is turned on, the second transistor T2 is turned off, and the second terminal of the third transistor T3 has no signal output. In the second stage: the first control signal terminal COMP provides a second level signal with a high level, the first transistor T1 is turned off, a scanning signal of the scanning signal terminal SCAN is a low level signal, the third transistor T3 is turned on, and the second transistor T2 is turned on under the control of an ultrasonic signal. In the third stage: the first control signal terminal COMP provides a second level signal with a high level, the first transistor T1 is turned off, a scanning signal of the scanning signal terminal SCAN is a high level signal, and the third transistor T3 is turned off.

Figure 6:
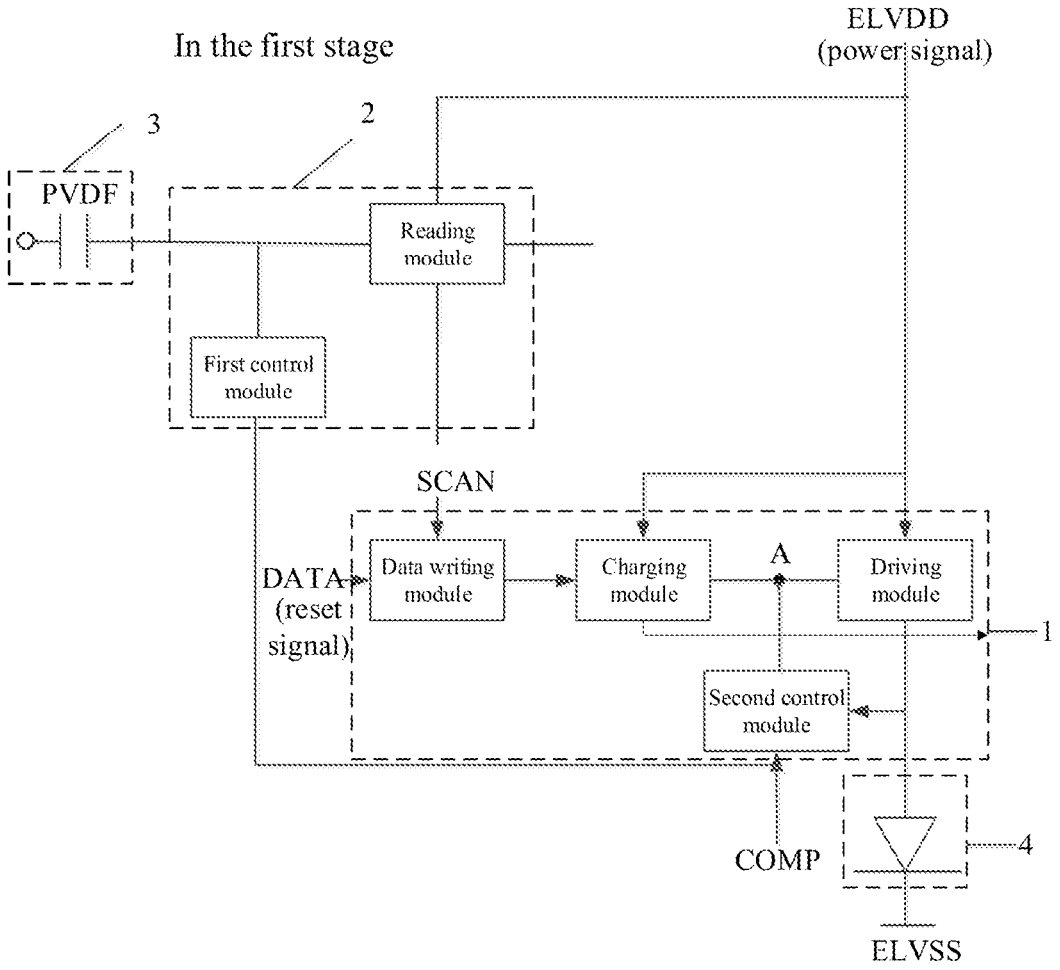
FIGS. 6-8 are schematic structural diagram of the working process a pixel circuit in different stages provided by an embodiment of the present application.
Figure 7:
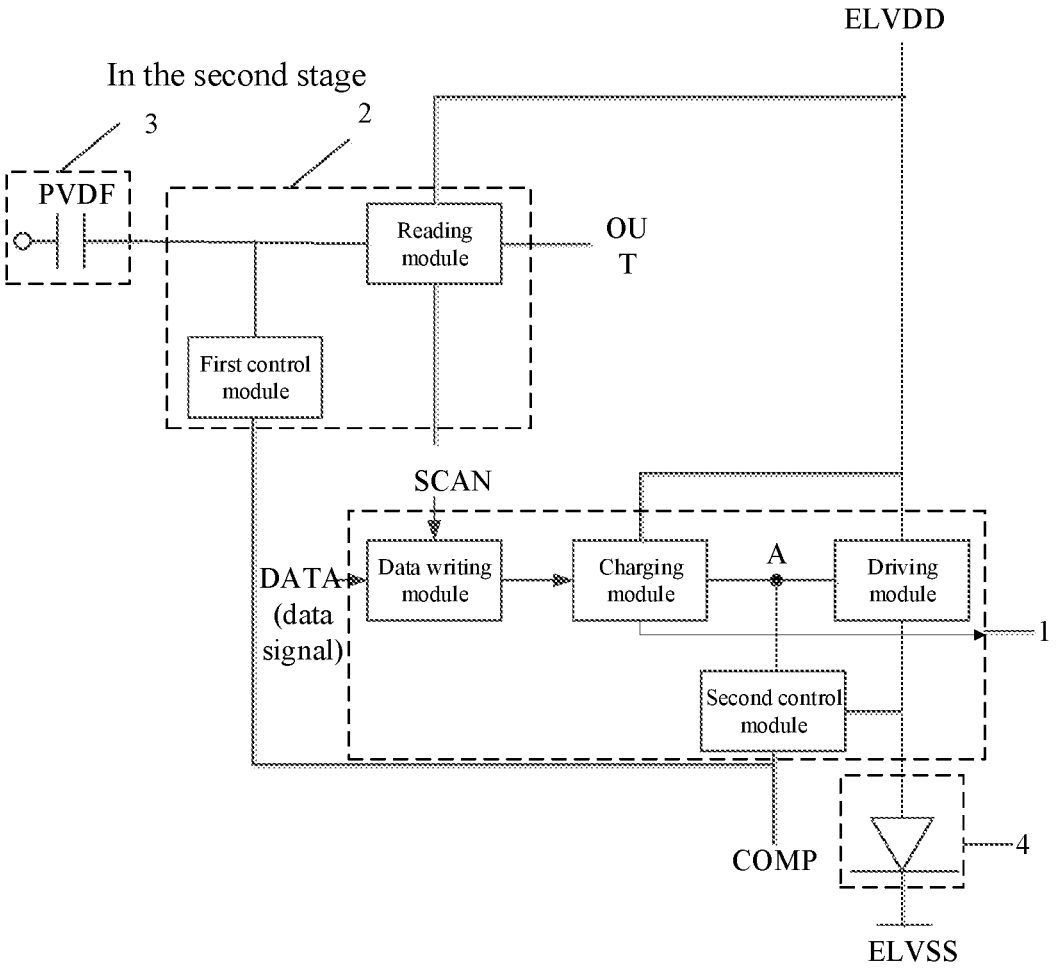
Figure 8:
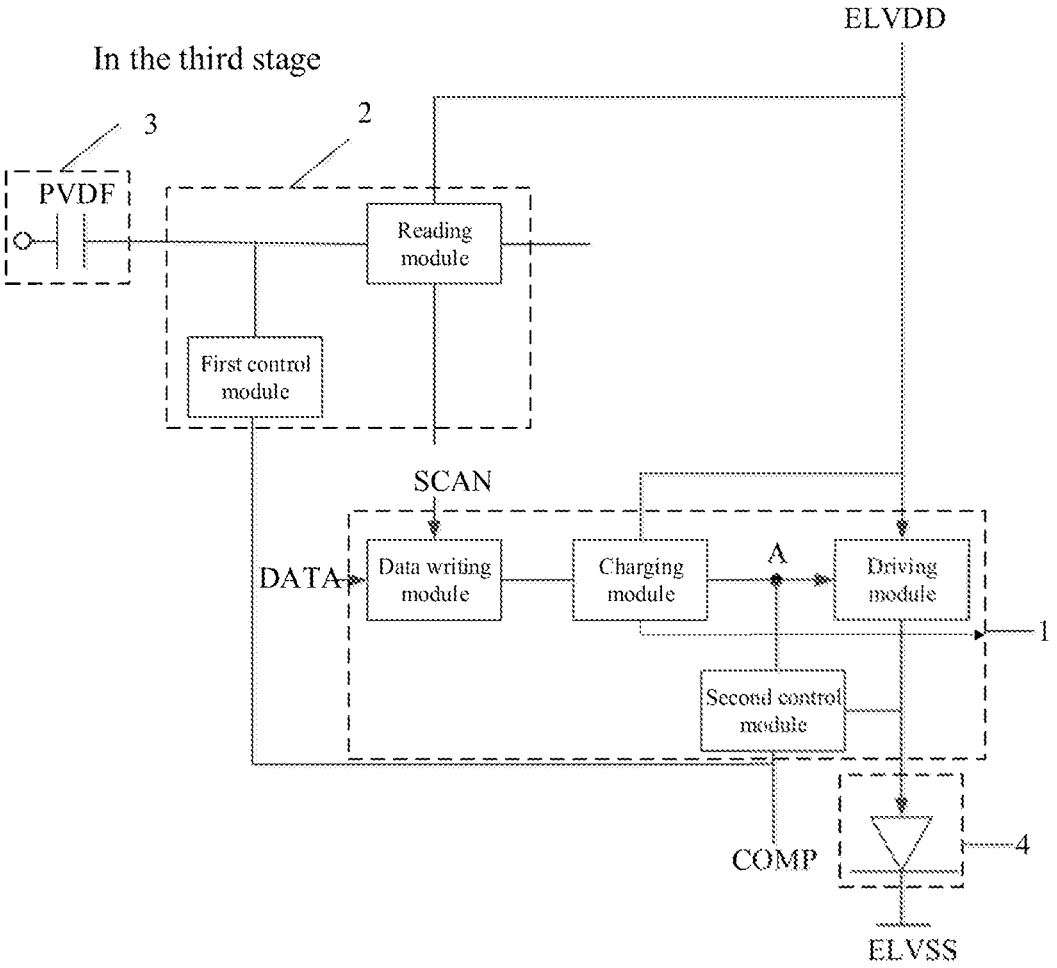

In some embodiments, as shown in FIG. 1, the pixel driving circuit 1 includes a driving module, a data writing module, a charging module and a second control module;

a control terminal of the data writing module is coupled to the scanning signal terminal SCAN, a first terminal of the data writing module is coupled to the data signal terminal DATA, and a second terminal of the data writing module is coupled to a first terminal of the charging module;

a second terminal of the charging module is coupled to the power supply terminal ELVDD, and a third terminal of the charging module, a control terminal of the driving module and a second terminal of the second control module are coupled to a first node A;

a first terminal of the driving module is coupled to the power supply terminal ELVDD, and a second terminal of the driving module is coupled to the light emitting device 4 and a first terminal of the second control module;

a control terminal of the second control module is coupled to the first control signal terminal COMP;

in the first stage: as shown in FIG. 6, the data writing module is configured to turn on the data signal terminal DATA and the charging module, and write a reset signal of the data signal terminal DATA into the charging module under the control of the scanning signal terminal SCAN; the driving module is configured to control to turn on the power supply terminal ELVDD and the second control module according to a potential of the first node A; the second control module is configured to charge the first node A by using a power signal of the power supply terminal ELVDD under the control of the first control signal terminal COMP, and when the potential of the first node A reaches a first preset potential, the driving module is further configured to control to turn off the power supply terminal ELVDD and the second control module according to the potential of the first node A;

in the second stage: as shown in FIG. 7, the data writing module is configured to turn on the data signal terminal DATA and the charging module, and write the data signal of the data signal terminal DATA into the charging module under the control of the scanning signal terminal SCAN, for the potential of the first node becoming a second preset potential; and in the third stage: as shown in FIG. 8, the data writing module is configured to turn off the data signal terminal DATA and the charging module under the control of the scanning signal terminal SCAN; and the driving module is configured to drive the light emitting device 4 to emit light according to the second preset potential and a potential of the power supply terminal ELVDD.

The first preset potential $V_{A1}=V_{ELVDD}+V_{th_T4}$, the second preset potential $V_{A2}=V_{ELVDD}\pm V_{th_T4}+(V_{data}-V_{ref})$, where $V_{ELVDD}$ is a voltage of a power signal of the first power supply terminal, $V_{th_T4}$ is a threshold voltage of the fourth transistor T4, $V_{data}$ is a voltage of a data signal provided by the data signal terminal, and $V_{ref}$ is a voltage of a reset signal provided by the data signal terminal.

In some embodiments, as shown in FIG. 2, the driving module includes a fourth transistor T4;

the data writing module includes a fifth transistor T5;

the charging module includes: a first capacitor C1 and a second capacitor C2;

the second control module includes a sixth transistor T6;

a gate of the fourth transistor T4 is coupled to a first electrode of the first capacitor C1, a first electrode of the fourth transistor T4 is coupled to the power supply terminal ELVDD, and a second electrode of the fourth transistor T4 is coupled to the light emitting device 4 and a first electrode of the sixth transistor T6;

a gate of the fifth transistor T5 is coupled to the scanning signal terminal SCAN, a first electrode of the fifth transistor T5 is coupled to the data signal terminal DATA, a second electrode of the fifth transistor T5 is coupled to a second electrode of the first capacitor C1 and a second electrode of the second capacitor C2, a first electrode of the first capacitor C1 is further coupled to a second electrode of the sixth transistor T6, and a first electrode of the second capacitor C2 is coupled to the power supply terminal ELVDD; and a gate of the sixth transistor T6 is coupled to the first control signal terminal COMP.

In some embodiments, in the first stage, the fifth transistor T5 is turned on under the control of the scanning signal terminal SCAN, a reset signal of the data signal terminal DATA is written into a second electrode of the first capacitor C1 and a second electrode of the second capacitor C2, left terminals of the first capacitor and the second capacitor are charged, the fourth transistor T4 is turned on under the control of a potential of the first node A, the sixth transistor T6 is turned on under the control of the first control signal terminal COMP, a power signal of the power supply terminal ELVDD is written to the first node A, and when the potential of the first node A reaches a first preset potential, the fourth transistor T4 is turned off. In the second stage, the fifth transistor T5 is turned on under the control of the scanning signal terminal SCAN, a data signal of the data signal terminal DATA is written into the second electrode of the first capacitor C1 and the second electrode of the second capacitor C2, the potential of the first node A becomes a second preset potential through a bootstrap effect of the first capacitor C1, and the sixth transistor T6 is turned off under the control of the first control signal terminal COMP. In the third stage, the fifth transistor T5 is turned off under the control of the scanning signal terminal SCAN, the sixth transistor T6 is turned off under the control of the first control signal terminal COMP, and the fourth transistor T4 is turned on to control the light emitting device to emit light.

In some embodiments, the fourth transistor, the fifth transistor and the sixth transistor are P-channel transistors.

Figure 9:
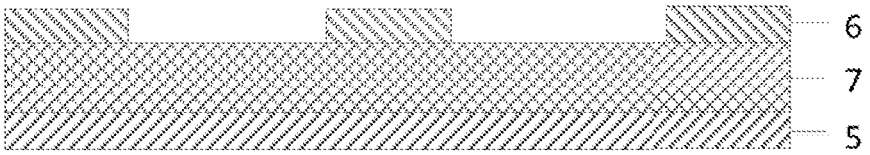
FIG. 9 is a schematic structural diagram of an ultrasonic device provided by an embodiment of the present application.

As shown in FIG. 9, the ultrasonic device may include, such as, a first electrode 5, a second electrode 6 and a piezoelectric layer 7 between the first electrode 5 and the second electrode 6. In FIG. 9, a material of the piezoelectric layer in the ultrasonic device may be, such as, polyvinylidene fluoride (PVDF), and the light emitting device may be, such as, an organic light-emitting diode (OLED) device. In some embodiments, in the first stage, the ultrasonic device receives a scanning signal of the scanning signal terminal through the ultrasonic line recognition circuit for ultrasonic emission. In the second stage, when an ultrasonic signal reflected by a line reaches a piezoelectric film layer, the ultrasonic signal will be converted into an alternating current (AC) voltage and will be received and output through an electrode layer. Due to varying reflection energy of a line ridge and valley, a reflected signal varies to realize line detection. In some embodiments, the ultrasonic line recognition circuit is coupled to a first electrode of PVDF. In the first stage, a scanning signal is loaded to the first electrode through the ultrasonic line recognition circuit to generate an AC signal at the second electrode and an ultrasonic wave through the piezoelectric layer. In the second stage, the ultrasonic wave reflected by the line will be converted into an AC voltage when reaching the piezoelectric film layer, which is received by the first electrode and output to the ultrasonic line recognition circuit to realize the line detection.

Taking the pixel circuit as shown in FIG. 2 as an example, a working process of the pixel circuit provided by an embodiment of the present application will be illustrated by an example, where the first transistor T1, the third transistor T3, the fourth transistor T4, the fifth transistor T5 and the sixth transistor T6 are P-channel transistors, and the second transistor T2 is an N-channel transistor. The working process of the pixel circuit is as follows:

in the first stage, a first level signal is loaded to the first control signal terminal COMP, the first level signal is a low level signal, a scanning signal is loaded to the scanning signal terminal SCAN, and a reset signal is loaded to the data signal terminal DATA; the first transistor T1, the third transistor T3, the fourth transistor T4, the sixth transistor T6 and the fifth transistor T5 are turned on, while the second transistor T2 is turned off; the scanning signal of the scanning signal terminal SCAN is transmitted to the ultrasonic device through the first transistor T1, the reset signal is written into second electrodes of the first capacitor C1 and the second capacitor C2 through the fifth transistor T5, left terminals of the first capacitor and the second capacitor are charged, a power signal of the power supply terminal ELVDD is written into the first node A through the fourth transistor T4 and the sixth transistor T6; and the fourth transistor T4 is turned off when a potential of the first node A reaches a first preset potential;

the first level signal needs to satisfy: $V_{comp}<V_{th_T1}+V_{scan}$, where $V_{comp}$ is a voltage of the first level signal loaded on the first control signal terminal, $V_{th_T1}$ is a threshold voltage of the first transistor T1, and $V_{scan}$ is a voltage of the low level signal of the scanning signal of the scanning signal terminal in the first stage;

in the second stage, a second level signal is loaded to the first control signal terminal COMP, the second level signal is a high level signal, a scanning signal is loaded to the scanning signal terminal SCAN, and a data signal is loaded to the data signal terminal DATA; the first transistor T1, the fourth transistor T4 and the sixth transistor T6 are turned off, while the third transistor T3 and the fifth transistor T5 are turned on; the data signal of the data signal terminal DATA is written into the second electrode of the first capacitor C1 and the second electrode of the second capacitor C2 through the fifth transistor T5; a potential of the first node A becomes a second preset potential through a bootstrap effect of the first capacitor C1; the second transistor T2 is turned on under the control of the ultrasonic signal; and the second electrode OUT of the third transistor T3 outputs a line recognition signal; and in the third stage, the second level signal is loaded to the first control signal terminal COMP, the scanning signal is loaded to the scanning signal terminal SCAN, the second transistor T2 is turned on, while the first transistor T1, the third transistor T3, the fifth transistor T5 and the sixth transistor T6 are turned off, and the fourth transistor T4 is turned on to control an OLED to emit light.

In the third stage, an OLED current $$I=\frac{W\times C\times u}{2L(V_{Data}-v_{ref})^2}$$

, where C is a capacitance per unit area of a channel of the fourth transistor T4, u is a mobility of the channel of the fourth transistor T4, W is a width of the channel of the fourth transistor T4, and L is a length of the channel of the fourth transistor T4.

Figure 10:
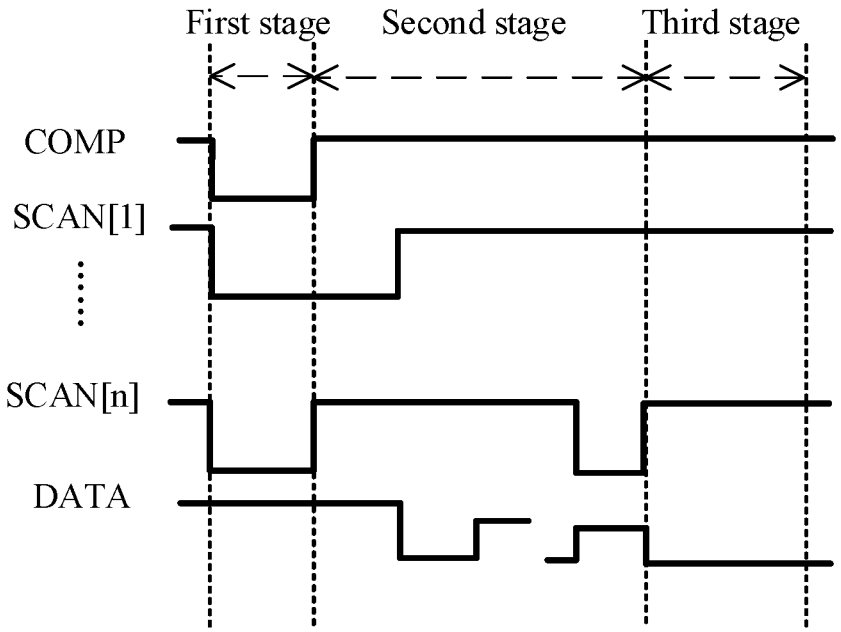
FIG. 10 is a timing diagram of the pixel circuit shown in FIG. 2 provided by an embodiment of the present application.
Figure 11:
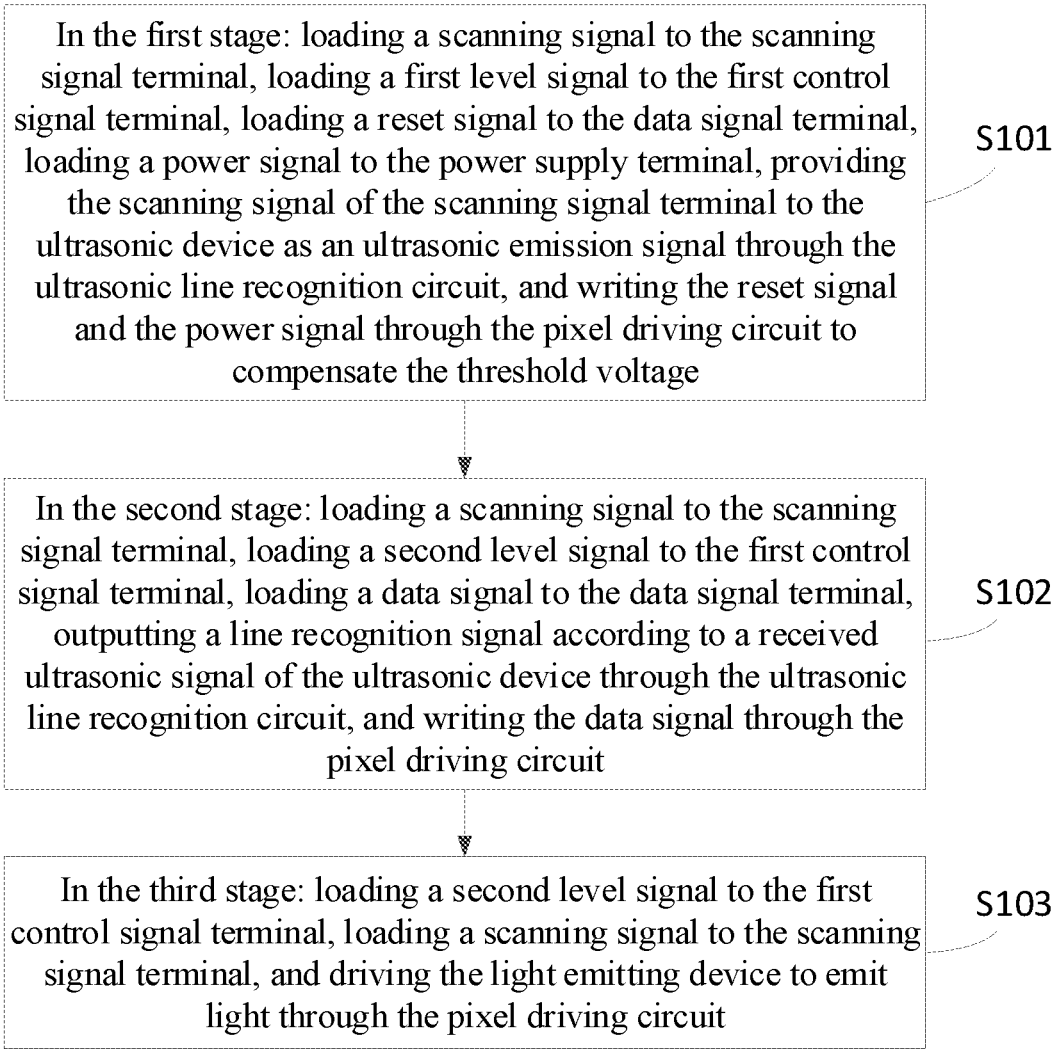
FIG. 11 is a schematic diagram of a method for driving a pixel circuit provided by an embodiment of the present application.

In some embodiments, a display area of a display product may include, such as n rows of pixels, where n>1 and n is an integer. The first control signal can be loaded to all rows of pixels through the first control signal terminal at the same time, and scanning signals SCAN[1] to SCAN[n] are provided to n rows of pixels through the scanning signal terminal respectively. Take the scanning signal terminal SCAN inputting a scanning signal SCAN[n] in the pixel circuit shown in FIG. 2 as an example, a timing diagram of the pixel circuit is shown in FIG. 10.

On the basis of the same inventive concept, an embodiment of the present application further provides a method for driving a pixel circuit, as shown in FIGS. 3-5 and 11, and the method includes:

S101, in the first stage: loading a scanning signal to the scanning signal terminal, loading a first level signal to the first control signal terminal, loading a reset signal to the data signal terminal, loading a power signal to the power supply terminal, providing the scanning signal of the scanning signal terminal to the ultrasonic device as an ultrasonic emission signal through the ultrasonic line recognition circuit, and writing the reset signal and the power signal through the pixel driving circuit to compensate the threshold voltage;

S102, in the second stage: loading a scanning signal to the scanning signal terminal, loading a second level signal to the first control signal terminal, loading a data signal to the data signal terminal, outputting a line recognition signal according to a received ultrasonic signal of the ultrasonic device through the ultrasonic line recognition circuit, and writing the data signal through the pixel driving circuit; and S103, in the third stage: loading a second level signal to the first control signal terminal, loading a scanning signal to the scanning signal terminal, and driving the light emitting device to emit light through the pixel driving circuit.

The method for driving a pixel circuit provided by an embodiment of the present application controls a pixel driving circuit and an ultrasonic line recognition circuit by using a same power supply terminal, a same scanning signal terminal and a same first control signal terminal, so that when performing line recognition, the ultrasonic line recognition circuit can be compatible with a relevant signal of the pixel driving circuit, the ultrasonic line recognition circuit and the pixel driving circuit are integrated to realize the integration of an ultrasonic fingerprint recognition driving circuit and the pixel driving circuit. Therefore, the pixel circuit can realize both an ultrasonic line recognition function and driving of the light emitting device to emit light, which simplifies design complexity of a driving circuit of a display product with a line recognition function.

In some embodiments, when the pixel circuit is a pixel circuit shown in FIG. 2, and the first transistor T1, the third transistor T3, the fourth transistor T4, the fifth transistor T5, and the sixth transistor T6 are P-channel transistors, and the second transistor T2 is an N-channel transistor, the first level signal is a low level signal, and the second level signal is a high level signal.

Figure 12:
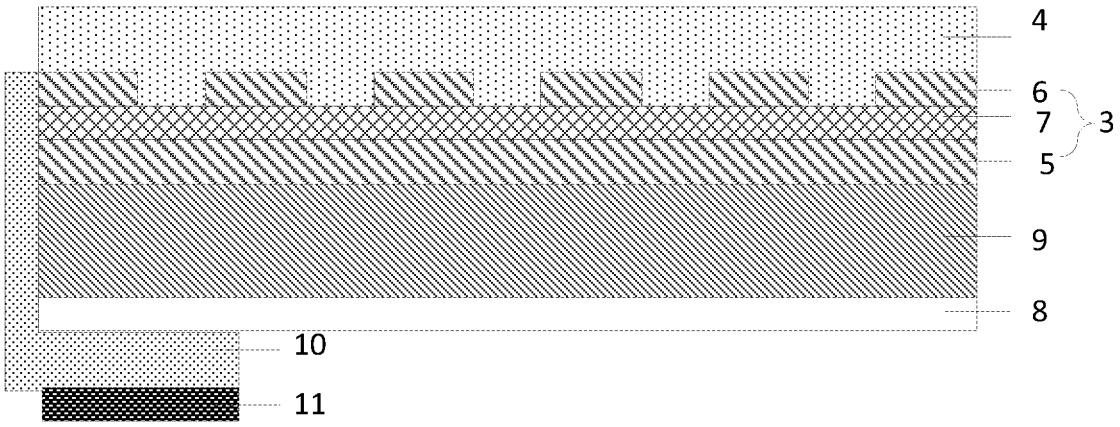
FIG. 12 is a schematic structural diagram of a display panel provided by an embodiment of the present application.

An embodiment of the present application provides a display panel, as shown in FIG. 12, and the display panel includes a base substrate 8, a pixel circuit 9 provided by an embodiment of the present application on the base substrate 8, an ultrasonic device 3 on the pixel circuit 9, and a light emitting device 4 on the ultrasonic device 3. As shown in FIG. 12, the ultrasonic device 3 includes a first electrode 5, a second electrode 6 and a piezoelectric layer 7 between the first electrode 5 and the second electrode 6. In some embodiments, the second electrode 6 is electrically connected to a signal processing chip 11 through a flexible circuit board 10.

In the display panel provided by an embodiment of the present application, a pixel circuit integrating an ultrasonic line recognition circuit and a pixel driving circuit is provided in the display panel, so that an ultrasonic fingerprint recognition driving circuit and the pixel driving circuit are integrated in the display panel, without additionally setting up an ultrasonic line recognition module to integrate with the display panel, which simplifies a structure of the display panel and a preparation process of the display panel, saves costs, and can also reduce a thickness of a display product with an ultrasonic line recognition function.

In conclusion, an embodiment of the present application provides a pixel circuit, a method for driving the same, and a display panel, and the pixel circuit includes a pixel driving circuit and an ultrasonic line recognition circuit, the pixel driving circuit and the ultrasonic line recognition circuit are coupled to a same power supply terminal, a same scanning signal terminal, and a same first control signal terminal. When performing line recognition, the ultrasonic line recognition circuit can be compatible with a relevant signal of the pixel driving circuit, the ultrasonic line recognition circuit and the pixel driving circuit are integrated to realize the integration of an ultrasonic fingerprint recognition driving circuit and the pixel driving circuit. Therefore, the pixel circuit can realize both an ultrasonic line recognition function and driving of the light emitting device to emit light, which simplifies design complexity of a driving circuit of a display product with a line recognition function. Moreover, the ultrasonic line recognition circuit does not need to be arranged in a GOA area, and a frame size can also be reduced to achieve frame narrowing.

Obviously, those skilled in the art can make various modifications and variations to the present application without departing from the spirit and scope of the present application. Thus, if these modifications and variations of the present application fall within the scope of the claims of the present application and the equivalent art, the present application is also intended to include these modifications and variations.

What is claimed is:

1. A pixel circuit, comprising:

a pixel driving circuit and an ultrasonic line recognition circuit;

wherein the pixel driving circuit and the ultrasonic line recognition circuit are coupled to a same power supply terminal, a same first control signal terminal and a same scanning signal terminal;

the ultrasonic line recognition circuit is coupled to an ultrasonic device;

the pixel driving circuit is coupled to a data signal terminal and a light emitting device;

in a first stage:

under a control of the first control signal terminal, the ultrasonic line recognition circuit provides a scanning signal of the scanning signal terminal to the ultrasonic device as an ultrasonic emission signal; and under a control of the first control signal terminal and the scanning signal terminal, the pixel driving circuit writes a reset signal of the data signal terminal and a power signal of the power supply terminal to compensate a threshold voltage;

in a second stage:

under the control of the first control signal terminal and the scanning signal terminal, the ultrasonic line recognition circuit outputs a line recognition signal according to a received ultrasonic signal of the ultrasonic device, and the pixel driving circuit writes a data signal of the data signal terminal; and in a third stage:

under the control of the first control signal terminal and the scanning signal terminal, the pixel driving circuit drives the light emitting device to emit light.

2. The pixel circuit according to claim 1, wherein the ultrasonic line recognition circuit comprises a first control module and a reading module;

a control terminal of the first control module is coupled to the first control signal terminal, a first terminal of the first control module is coupled to the scanning signal terminal, and a second terminal of the first control module is coupled to the ultrasonic device;

a first control terminal of the reading module is coupled to the scanning signal terminal, a second control terminal of the reading module is coupled to the ultrasonic device, a first terminal of the reading module is coupled to the power supply terminal, and a second terminal of the reading module outputs the line recognition signal;

in the first stage:

the first control module is configured to turn on the scanning signal terminal and the ultrasonic device under the control of the first control signal terminal; and in the second stage:

the first control module is configured to turn off the scanning signal terminal and the ultrasonic device under the control of the first control signal terminal; and the reading module is configured to output the line recognition signal according to the ultrasonic signal under the control of the scanning signal terminal.

3. The pixel circuit according to claim 2, wherein the first control module comprises a first transistor;

a gate of the first transistor is coupled to the first control signal terminal;

a first electrode of the first transistor is coupled to the scanning signal terminal; and a second electrode of the first transistor is coupled to the ultrasonic device.

4. The pixel circuit according to claim 3, wherein the reading module comprises a second transistor and a third transistor;

a gate of the second transistor is coupled to the ultrasonic device;

a first electrode of the second transistor is coupled to the power supply terminal;

a second electrode of the second transistor is coupled to a first electrode of the third transistor;

a gate of the third transistor is coupled to the scanning signal terminal; and a second electrode of the third transistor outputs the line recognition signal.

5. The pixel circuit according to claim 4, wherein the first transistor and the third transistor are P-channel transistors, and the second transistor is an N-channel transistor.

6. The pixel circuit according to claim 1, wherein the pixel driving circuit comprises a driving module, a data writing module, a charging module, and a second control module;

a control terminal of the data writing module is coupled to the scanning signal terminal, a first terminal of the data writing module is coupled to the data signal terminal, and a second terminal of the data writing module is coupled to a first terminal of the charging module;

a second terminal of the charging module is coupled to the power supply terminal;

a third terminal of the charging module, a control terminal of the driving module and a second terminal of the second control module are coupled to a first node respectively;

a first terminal of the driving module is coupled to the power supply terminal, and a second terminal of the driving module is coupled to the light emitting device and a first terminal of the second control module;

a control terminal of the second control module is coupled to the first control signal terminal;

in the first stage:

the data writing module is configured to turn on the data signal terminal and the charging module, and write a reset signal of the data signal terminal into the charging module under the control of the scanning signal terminal;

the driving module is configured to control to turn on the power supply terminal and the second control module according to a potential of the first node;

the second control module is configured to charge the first node by using a power signal of the power supply terminal under the control of the first control signal terminal, and when the potential of the first node reaches a first preset potential, the driving module is further configured to control to turn off the power supply terminal and the second control module according to the potential of the first node;

in the second stage:

the data writing module is configured to turn on the data signal terminal and the charging module, and write the data signal of the data signal terminal into the charging module under the control of the scanning signal terminal, for the potential of the first node becoming a second preset potential; and in the third stage:

the data writing module is configured to turn off the data signal terminal and the charging module under the control of the scanning signal terminal; and the driving module is configured to drive the light emitting device to emit light according to the second preset potential and a potential of the power supply terminal.

7. The pixel circuit according to claim 6, wherein the driving module comprises a fourth transistor;

the data writing module comprises a fifth transistor;

the charging module comprises a first capacitor and a second capacitor;

the second control module comprises a sixth transistor;

a gate of the fourth transistor is coupled to a first electrode of the first capacitor, a first electrode of the fourth transistor is coupled to the power supply terminal, and a second electrode of the fourth transistor is coupled to the light emitting device and a first electrode of the sixth transistor;

a gate of the fifth transistor is coupled to the scanning signal terminal, a first electrode of the fifth transistor is coupled to the data signal terminal, and a second electrode of the fifth transistor is coupled to a second electrode of the first capacitor and a second electrode of the second capacitor;

a first electrode of the first capacitor is further coupled to a second electrode of the sixth transistor, and a first electrode of the second capacitor is coupled to the power supply terminal; and a gate of the sixth transistor is coupled to the first control signal terminal.

8. The pixel circuit according to claim 7, wherein the fourth transistor, the fifth transistor and the sixth transistor are P-channel transistors.

9. A method for driving the pixel circuit according to claim 1, comprising:

in the first stage:

loading the scanning signal to the scanning signal terminal, loading a first level signal to the first control signal terminal, loading the reset signal to the data signal terminal, loading the power signal to the power supply terminal, providing the scanning signal of the scanning signal terminal to the ultrasonic device as the ultrasonic emission signal through the ultrasonic line recognition circuit, and writing the reset signal and the power signal through the pixel driving circuit to compensate the threshold voltage;

in the second stage:

loading the scanning signal to the scanning signal terminal, loading a second level signal to the first control signal terminal, loading the data signal to the data signal terminal, outputting the line recognition signal according to the received ultrasonic signal of the ultrasonic device through the ultrasonic line recognition circuit, and writing the data signal through the pixel driving circuit; and in the third stage:

loading the second level signal to the first control signal terminal, loading the scanning signal to the scanning signal terminal, and driving the light emitting device to emit light through the pixel driving circuit.

10. A display panel, comprising:

a base substrate, the pixel circuit according to claim 1 on the base substrate, the ultrasonic device on the pixel circuit, and the light emitting device on the ultrasonic device.

* * * * *